US006234863B1

(12) United States Patent
Hughey et al.

(10) Patent No.: US 6,234,863 B1
(45) Date of Patent: May 22, 2001

(54) AMUSEMENT DEVICE RESEMBLING LIVING BEING HAVING PARAPHERNALIA ITEM AND ASSOCIATED BELLY MEMBER

(75) Inventors: Billy F. Hughey, El Reno; Nathan T. Simonton, Minco, both of OK (US)

(73) Assignee: Rainbow Studies, Inc., El Reno, OK (US)

( * ) Notice: Subject to any disclaimer, the term of this patent is extended or adjusted under 35 U.S.C. 154(b) by 0 days.

(21) Appl. No.: 09/465,194

(22) Filed: Dec. 15, 1999

(51) Int. Cl.[7] ..... A63H 3/02
(52) U.S. Cl. ..... 446/369; 496/268
(58) Field of Search ..... 446/5, 71, 72, 446/73, 75, 76, 77, 268, 369; D21/604, 605

(56) References Cited

U.S. PATENT DOCUMENTS

| | | | | |
|---|---|---|---|---|
| D. 261,161 | | 10/1981 | Ohkawa . | |
| D. 274,923 | | 7/1984 | Ikeda . | |
| D. 275,024 | | 8/1984 | Ikeda . | |
| D. 318,311 | | 7/1991 | Chen . | |
| D. 408,674 | | 4/1999 | Bear . | |
| 4,883,441 | * | 11/1989 | Byer | 446/369 |
| 4,883,442 | * | 11/1989 | Kaplan | 446/369 |
| 5,114,376 | * | 5/1992 | Copley et al. | 446/369 |
| 5,232,390 | * | 8/1993 | Brooks | 446/268 |
| 5,340,348 | * | 8/1994 | Schroeder | 446/75 |
| 5,503,584 | | 4/1996 | Tulling . | |
| 5,684,758 | | 11/1997 | Gray et al. . | |
| 5,779,570 | * | 7/1998 | Bear | 446/369 |
| 5,807,112 | * | 9/1998 | Zeck | 446/72 |
| 5,807,155 | * | 9/1998 | Divleeon | 446/73 |
| 5,888,117 | * | 3/1999 | Sutton | 446/369 |
| 5,890,942 | * | 4/1999 | Souza-Ferreira et al. | 446/268 |

* cited by examiner

*Primary Examiner*—Sam Rimell
(74) *Attorney, Agent, or Firm*—Maginot, Addison & Moore

(57) ABSTRACT

An amusement device is disclosed which includes a body structure configured to resemble a living being (e.g. a bear) which is engaging in a specific sporting activity (e.g. the sport of basketball). The amusement device further includes a paraphernalia item associated with the specific sporting activity supported by the body structure. Additionally, the amusement device includes a belly member supported by the body structure at an abdominal area of the body structure so as to simulate an extended belly of the living being. The belly member is configured to be at least a partial facsimile of the paraphernalia item. Alternatively, the belly member may be configured to resemble at least a portion of a second paraphernalia item associated with the specific sporting activity.

20 Claims, 10 Drawing Sheets

AMUSEMENT DEVICE RESEMBLING LIVING BEING HAVING PARAPHERNALIA ITEM AND ASSOCIATED BELLY MEMBER

CROSS REFERENCE

Cross reference is made to co-pending U.S. patent application Ser. No. 29/115,503, entitled "Figurine" by Billy F. Hughey and Nathan T. Simonton filed on the same date herewith.

BACKGROUND OF THE INVENTION

The present invention relates generally to an amusement device, and more particularly to an amusement device which is configured to resemble a living being engaging in a specific activity such as a sporting activity.

Numerous amusement devices in the form of a figurine or a stuffed toy have heretofore been designed. Such figurines and stuffed toys have often been configured to resemble a living being such as an animal (e.g. a teddy bear). In addition, it is also common to provide such a figurine or stuffed toy with paraphernalia such as equipment, clothing or other gear related to a particular activity (e.g. a sporting activity) thereby providing the amusement device with a motif.

Some examples of designs of figurines and stuffed toys are disclosed in the following patents: U.S. Pat. No. 5,503,584 (stuffed toy animal engaging in the sport of parachuting); U.S. Pat. No. Des. 408,674 (stuffed toy animal engaging in the sport of baseball); U.S. Pat. No. Des. 275,024 (stuffed toy animal engaging in the sport of baseball); U.S. Pat. No. Des. 274,923 (stuffed toy animal engaging in the sport of football); U.S. Pat. No. Des. 261,161 (animal-shaped figurine engaging in the musical activity of drumming).

It is a goal of certain designers to configure figurines and stuffed toys to resemble likable characters having positive personality traits. For instance, it may be desirable to configure a figurine or a stuffed toy so that it resembles a happy, jolly, amiable, friendly, congenial, and good-natured character. One physical attribute that tends to provide a character with such positive personality traits relates to the shape of the character's belly. For example, when a character possesses an extended or enlarged belly, such as the ones carried around by most traditional grandfathers and almost every version of Santa Claus, a viewer may bestow upon that character a positive personality trait such as being happy, jolly, amiable, friendly, congenial, and good-natured.

It is a further goal of certain designers to provide figurines and stuffed toys with paraphernalia such as equipment, clothing or other gear related to a particular activity (e.g. a sporting activity) in as unique a manner as possible to increase the effect of a motif of the amusement device on a viewer.

What is needed therefore is an amusement device in the form of a figurine or stuffed toy that resembles a likable character and which is provided with paraphernalia in a highly unique manner which increases the effect of the motif of the amusement device on a viewer.

SUMMARY OF THE INVENTION

In accordance with one embodiment of the present invention, there is provided an amusement device which includes a body structure configured to resemble a living being which is engaging in a specific sporting activity. The amusement device further includes a paraphernalia item associated with the specific sporting activity supported by the body structure. Additionally, the amusement device includes a belly member supported by the body structure at an abdominal area of the body structure so as to simulate an extended belly of the living being. The belly member is configured to be at least a partial facsimile of the paraphernalia item.

Pursuant to another embodiment of the present invention, there is provided an amusement device. The amusement device includes a body structure configured to resemble a living being which is engaging in a specific recreational activity. The amusement device further includes a first paraphernalia item associated with the specific recreational activity supported by the body structure. Also, the amusement device includes a belly member supported by the body structure at an abdominal area of the body structure so as to simulate an extended belly of the living being. The belly member is configured to resemble at least a portion of a second paraphernalia item associated with the specific recreational activity.

According to still another embodiment of the present invention, there is provided an amusement device which includes a body structure configured to resemble a living being which is engaging in a specific activity. The amusement device further includes a paraphernalia item associated with the specific activity supported by the body structure. In addition, the amusement device includes a belly member supported by the body structure at an abdominal area of the body structure so as to simulate an extended belly of the living being. The belly member is configured to be at least a partial facsimile of the paraphernalia item.

In accordance with yet another embodiment of the present invention, there is provided an amusement device which includes a body structure configured to resemble a living being which is engaging in a specific activity. The amusement device further includes a paraphernalia item associated with the specific activity supported by the body structure. The amusement device also includes a belly member supported by the body structure at an abdominal area of the body structure so as to simulate an extended belly of the living being. The belly member is configured to resemble at least a portion of a second paraphernalia item associated with the specific activity.

It is therefore an object of the present invention to provide a new and useful amusement device.

It is another object of the present invention to provide an improved amusement device.

It is yet another object of the present invention to provide an amusement device which is provided with paraphernalia in a highly unique manner which increases the effect of a motif of the amusement device on a viewer.

It is also an object of the present invention to provide an amusement device in the form of a figurine or stuffed toy that resembles a likable character and which is provided with paraphernalia in a highly unique manner which increases the effect of a motif of the amusement device on a viewer.

Other objects and benefits of the present invention can be discerned from the following description and accompanying drawings.

DESCRIPTION OF THE PREFERRED EMBODIMENTS

Figure 1:
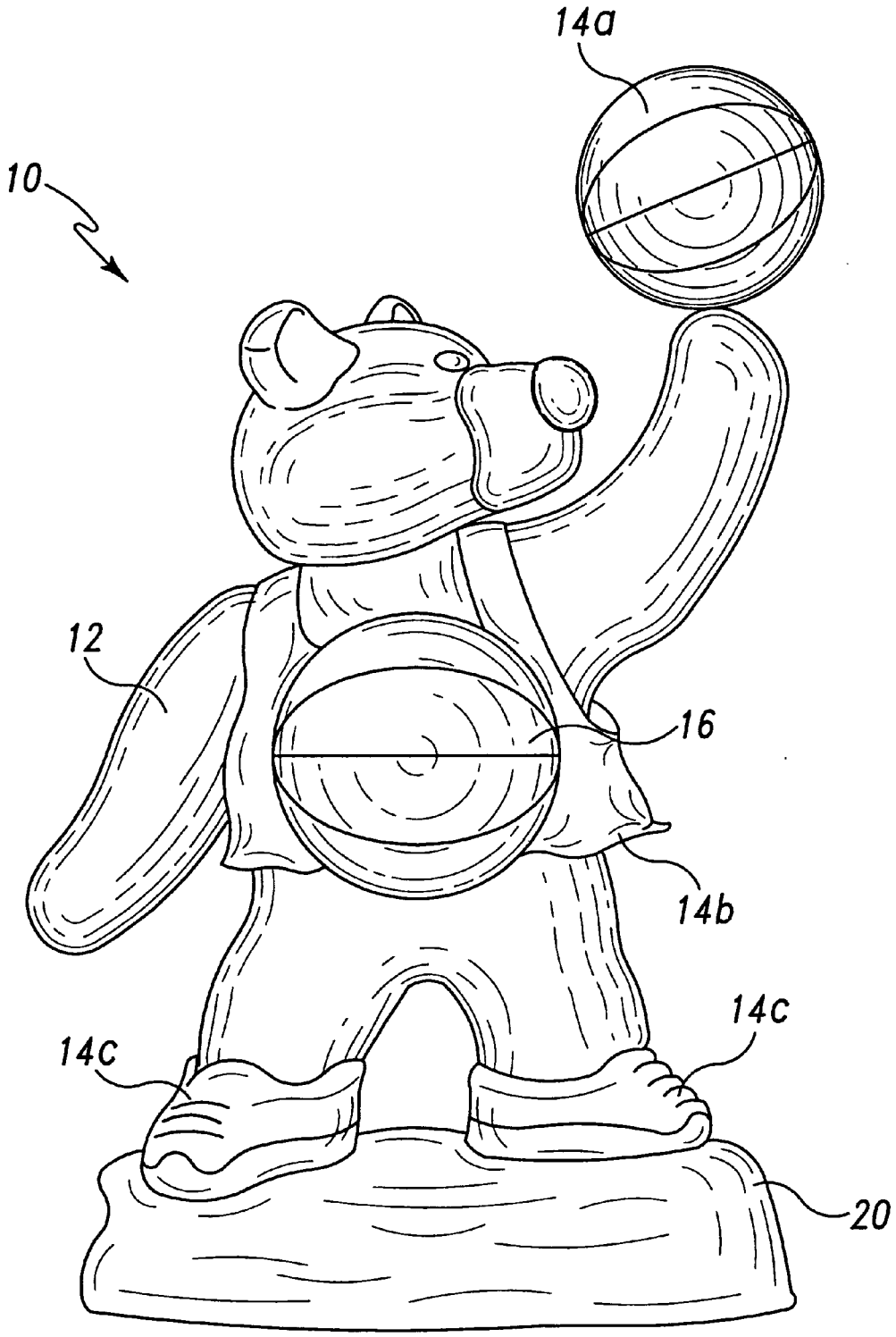
FIG. 1 is a front elevational view of a first embodiment of an amusement device which incorporates the features of the present invention.
Figure 2:
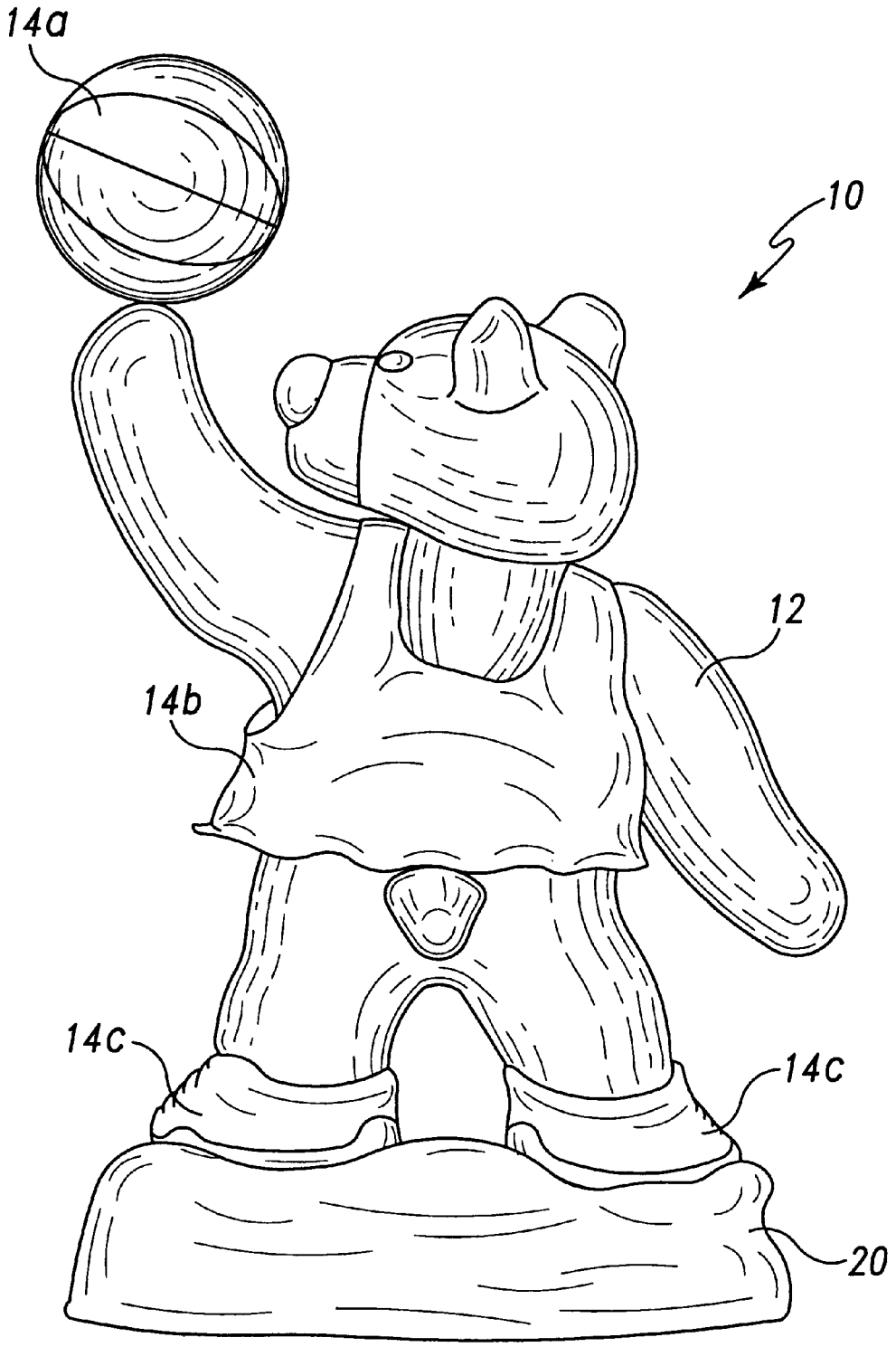
FIG. 2 is a rear elevational view of the amusement device of FIG. 1.
Figure 3:
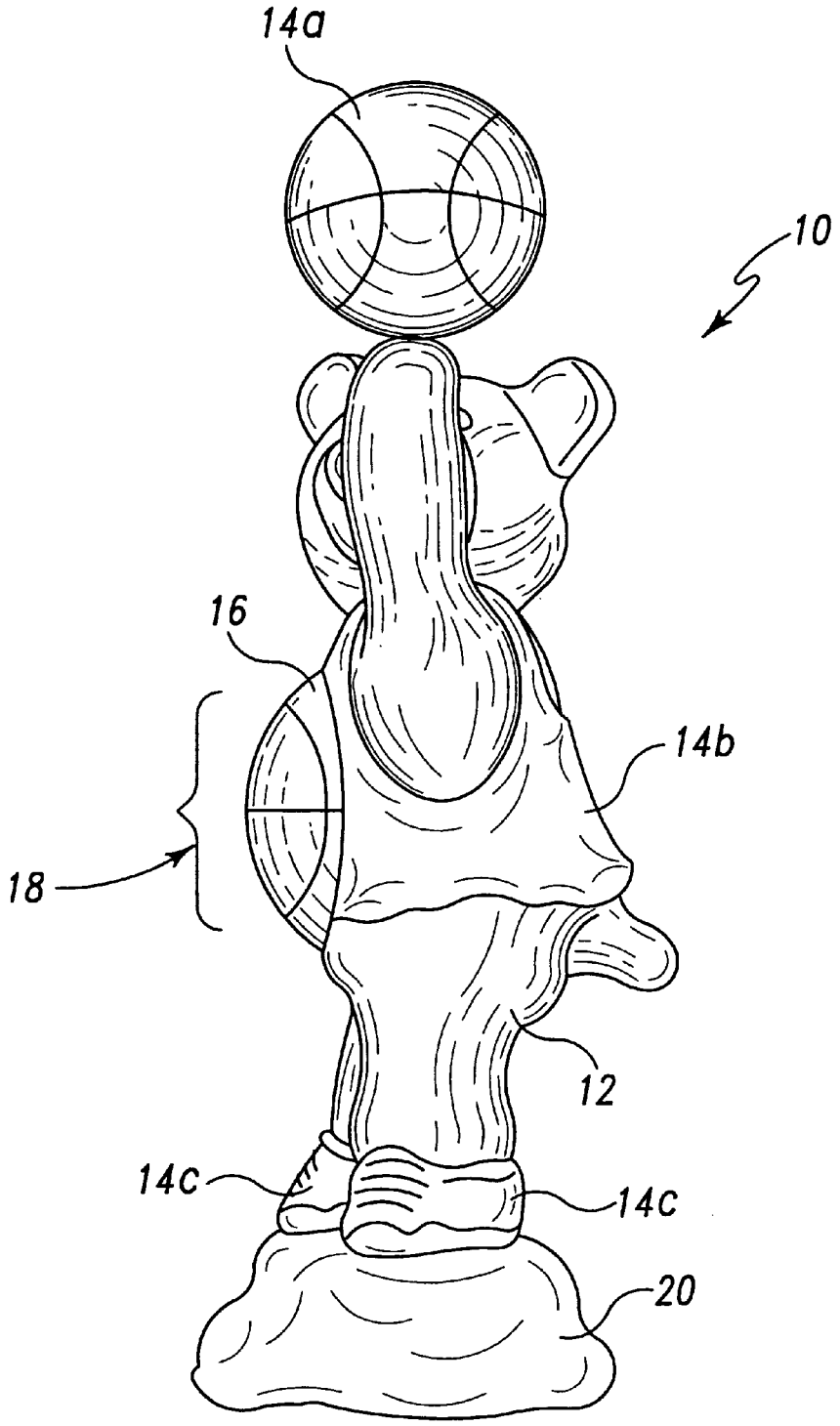
FIG. 3 is a left side elevational view of the amusement device of FIG. 1.
Figure 4:
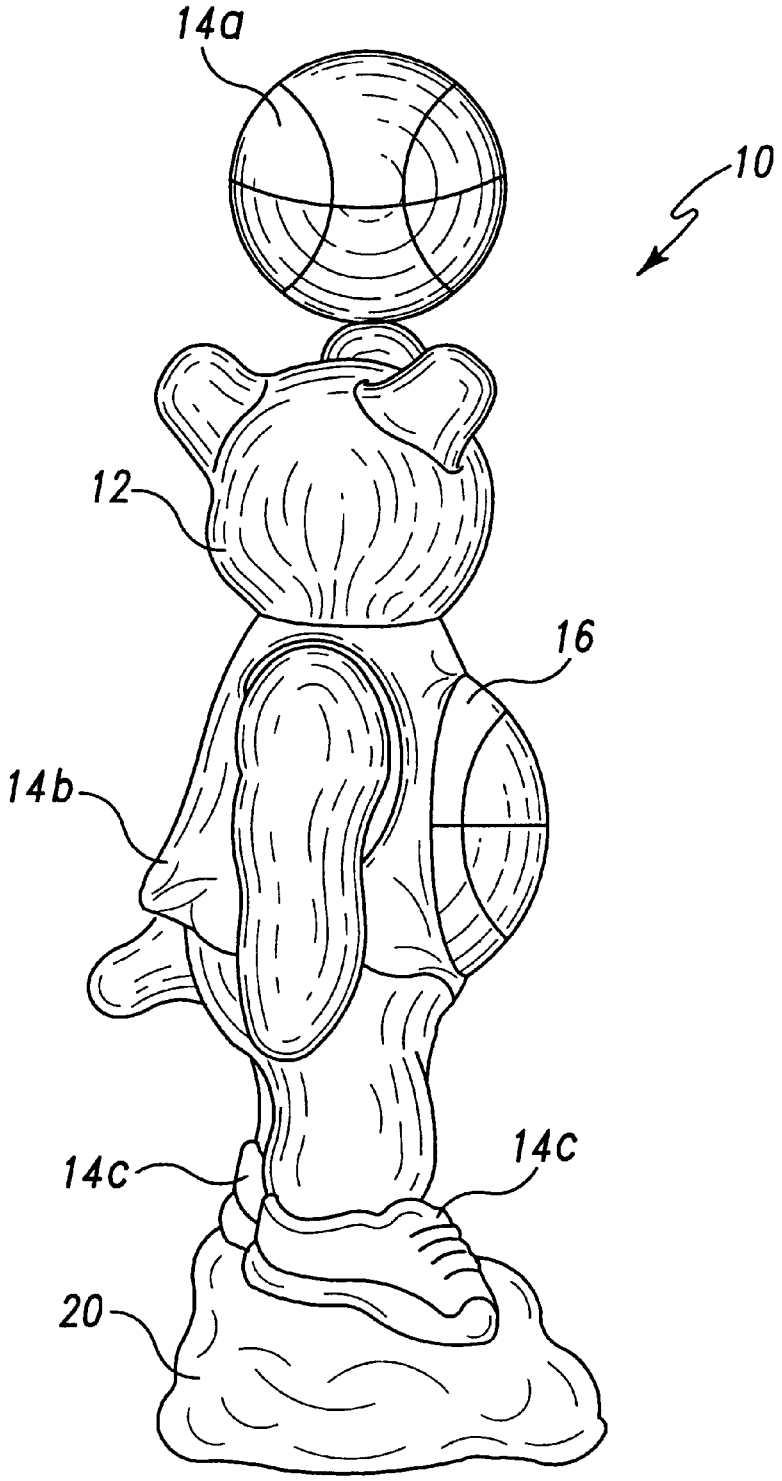
FIG. 4 is a right side elevational view of the amusement device of FIG. 1.
Figure 5:
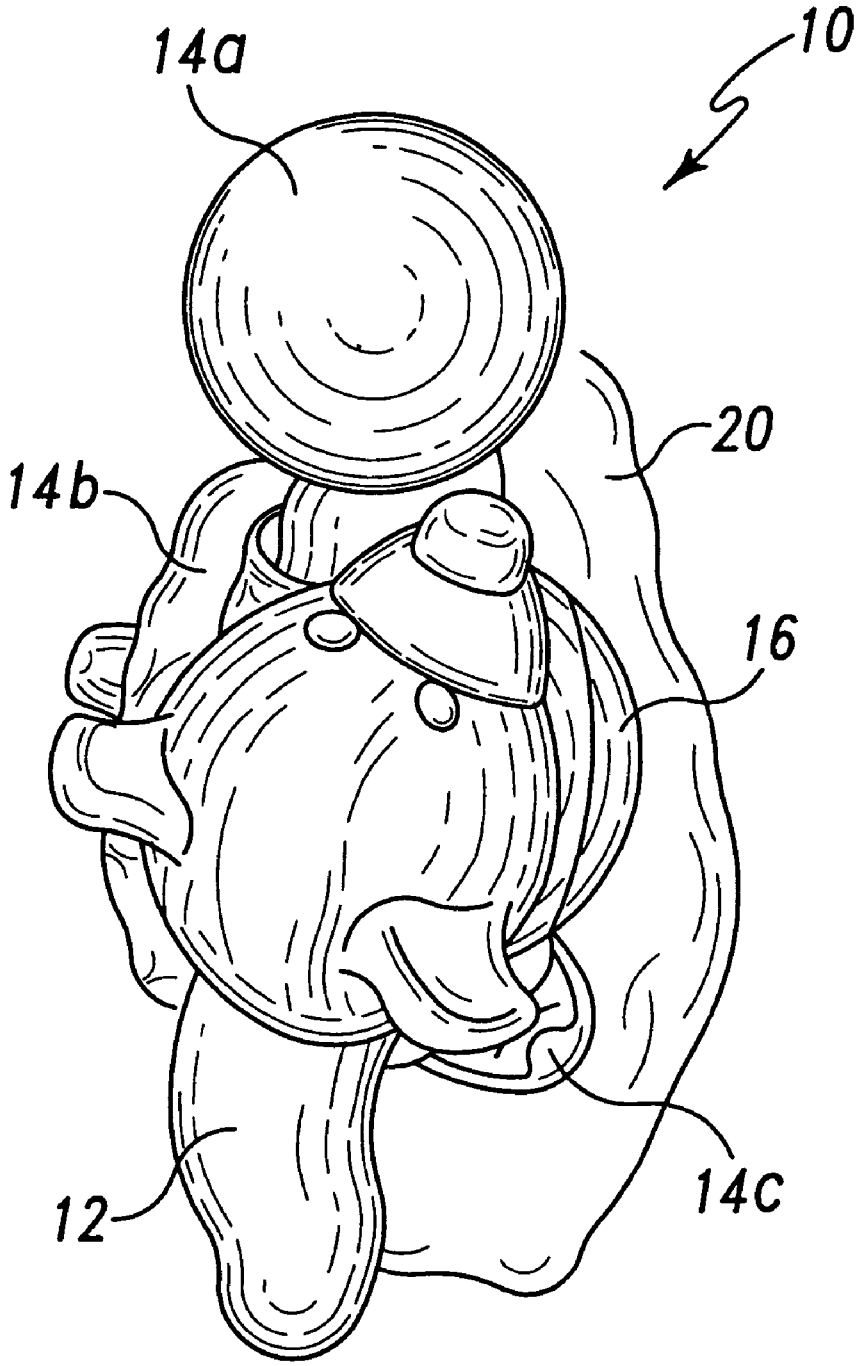
FIG. 5 is a top elevational view of the amusement device of FIG. 1.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

First Embodiment

Referring now to FIGS. 1–5, there is shown a first embodiment of an amusement device 10 which incorporates the features of the present invention therein. The amusement device 10 includes a body structure 12 that is configured to resemble a living being which is engaging in a specific activity. By way of example, FIGS. 1–5 show the living being to be a bear which is engaging in the sport of basketball. What is meant herein by the term "specific activity" is an activity which is identified with a specific endeavor, venture, enterprise, or undertaking. For example, one specific activity may be the sport of basketball, while another specific activity may be the sport of fishing. Yet another example of a specific activity may be a professional activity such as a dentist drilling a tooth of a patient. Yet another example of a specific activity may be the leisure or recreational activity of reading a book.

The body structure 12 includes a torso, a pair of arms, a pair of legs, and a head as shown in FIGS. 1–5. The body structure 12 supports a number of paraphernalia items 14 "associated with" a specific sporting activity in which the living being (i.e. the bear) is engaging. To provide meaning herein to the phrase "associated with", it should be appreciated that the following items are associated with the sport of basketball: a pair of basketball shoes, a basketball jersey, a basketball, a headband, a wristband, a pair of knee pads, and a basketball hoop. Thus, it should further be appreciated that the phrase "associated with" means "having a logical relationship with". It should be appreciated that a paraphernalia item such as a basketball has a logical relationship with the sport of basketball because a basketball is used while a player engages in the sport of basketball.

The paraphernalia items, collectively referred to in the text as reference number 14, include a basketball 14*a* supported on top of one of the hands defined by the body structure 12. The paraphernalia items 14 further include a basketball jersey 14*b* and a pair of basketball shoes 14*c* each which is configured so as to appear as if it is being worn by the bear as shown in FIGS. 1–5.

The amusement device 10 further includes a belly member 16 supported by the body structure 12 at an abdominal area 18 (see e.g. FIG. 3) of the body structure 12. The belly member 16 is configured and positioned in relation to the body structure 12 so as to simulate an extended belly of the living being (i.e. the bear). The belly member 16 is configured to be at least a partial facsimile of the basketball 14*a*. More specifically, the belly member 16 is configured to be a reproduction or copy of at least a limited portion of the basketball 14*a*. The belly member 16 may be the same size as the corresponding limited portion of the basketball 14*a*, or alternatively may be reduced or enlarged in size in relation to such limited portion of the basketball. In the embodiment shown in FIGS. 1–5, the belly member is shown to be slightly enlarged in size in relation to such limited portion of the basketball 14*a*.

The belly member 16, which simulates an extended belly of the bear in the embodiment shown in FIGS. 1–5, functions to provide the bear with the appearance of positive personality traits such as being happy, jolly, amiable, friendly, congenial, and good-natured. In addition, configuring the belly member 16 to be at least a partial facsimile of the basketball 14*a* provides a highly unique manner of further increasing the effect of a motif of the amusement device 10 on a viewer.

The amusement device 10 also includes a pedestal 20 on which the body structure 12 is supported. The pedestal 20 includes a flat bottom surface so as to provide stability to the amusement device 10.

The body structure 12, the paraphernalia items 14, the belly member 16, and the pedestal 20 are each made from a clay material. The body structure 12, the paraphernalia items 14, the belly member 16, and the pedestal 20 are integrally formed together so as to assume the shape as shown in FIGS. 1–5. The basketball 14*a* is formed separately but is supported on and secured to the top of the left arm of the bear as shown in FIGS. 1–5. In an alternative embodiment (not shown), the basketball 14*a* may be integrally formed together with the body structure 12, the paraphernalia items 14, the belly member 16, and the pedestal 20.

In order to furnish strength to the amusement device 10, a skeleton (not shown) may be provided internally throughout the body structure 12, the pedestal 20, and the basketball 14*a*. The skeleton may be made from a metal wire or mesh complex which extends from the pedestal 20 through the body structure 12 and into the basketball 14*a*. The skeleton may traverse the body structure 12 by extending into the bear's legs, torso, arms, and head.

Second Embodiment

Figure 6:
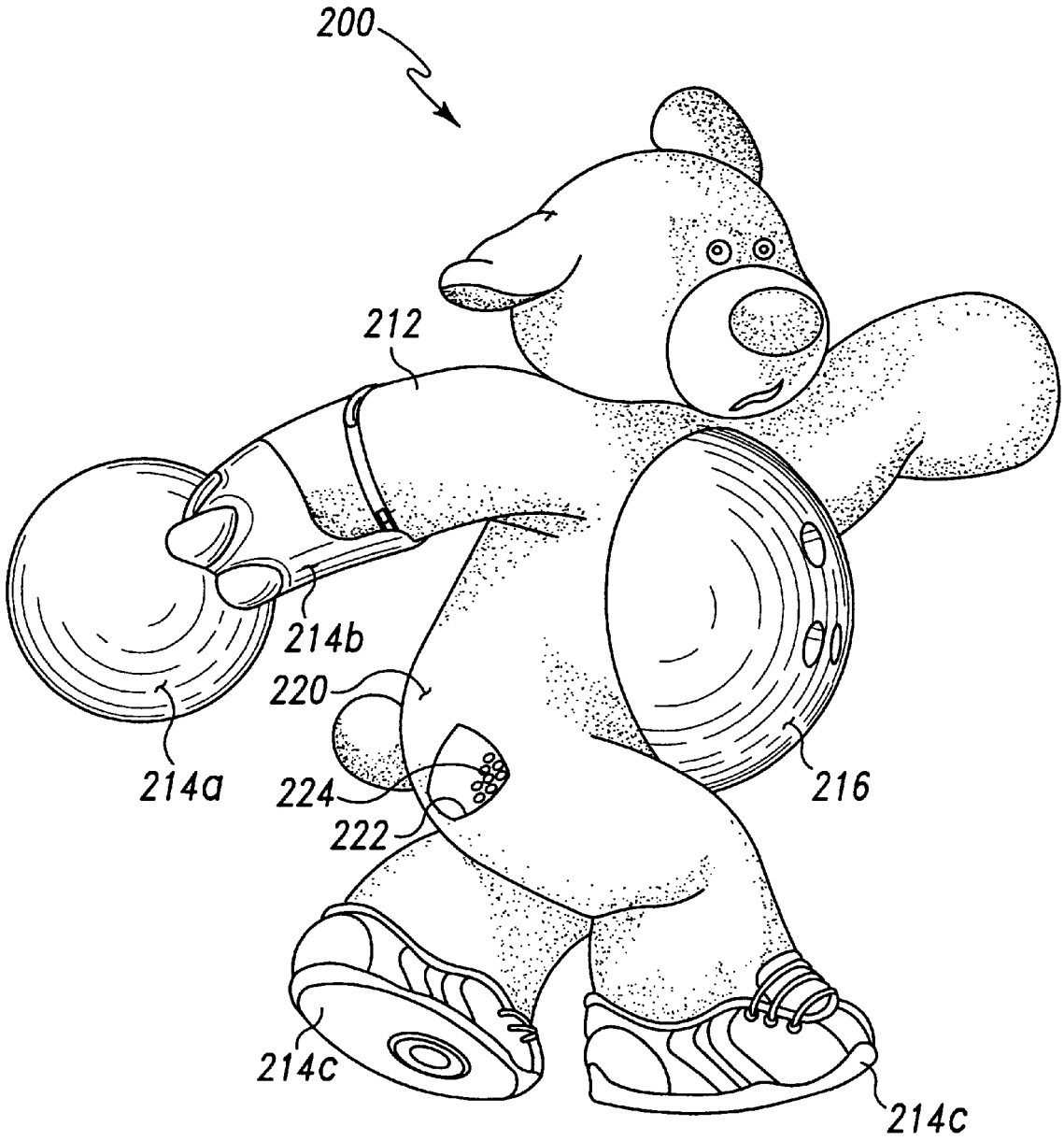
FIG. 6 is a perspective view of a second embodiment of an amusement device which incorporates the features of the present invention.

Referring now to FIG. 6, there is shown a second embodiment of an amusement device 200 which incorporates the features of the present invention therein. The amusement device 200 includes a body structure 212 which is configured to resemble a living being which is engaging in a specific activity. By way of example, FIG. 6 shows the living being to be a bear which is engaging in the sport of bowling. The body structure 212 includes an outer layer 220 which defines a stuffing cavity 222. Located within the stuffing cavity 222 is a quantity of stuffing material 224 which may be any known natural or synthetic material which is commonly utilized in the manufacture of stuffed toys. It should be appreciated that the presence of the stuffing material 224 gives the amusement device 200 a soft, compressible feel which is desirable to young children. Note that FIG. 6 shows a portion of the outer layer 220 removed to expose the interior of the stuffing cavity 222 for clarity of description.

The body structure 212 includes a torso, a pair of arms, a pair of legs, and a head as shown in FIG. 6. The body structure 212 supports a number of paraphernalia items 214 associated with a specific sporting activity in which the living being is engaging.

The paraphernalia items, collectively referred to in the text as reference number 214, include a bowling ball 214*a* supported by one of the hands defined by the body structure 212. The paraphernalia items 214 further include a bowling wrist brace 214*b* and a pair of bowling shoes 214*c* each which is configured so as to appear as if it is being worn by the bear as shown in FIG. 6.

The amusement device 200 further includes a belly member 216 supported by the body structure 212 at an abdominal area of the body structure 212. The belly member 216 is configured and positioned in relation to the body structure 212 so as to simulate an extended belly of the living being (i.e. the bear). The belly member 216 is configured to be at least a partial facsimile of the bowling ball 214*a*. More specifically, the belly member 216 is configured to be a reproduction or copy of at least a limited portion of the bowling ball 214*a*. The belly member 216 may be the same size as the corresponding limited portion of the bowling ball 214*a*, or alternatively may be reduced or enlarged in size in relation to such limited portion of the bowling ball. In the embodiment shown in FIG. 6, the belly member 216 is shown to be slightly enlarged in size in relation to such limited portion of the bowling ball 214*a*.

Third Embodiment

Figure 7:
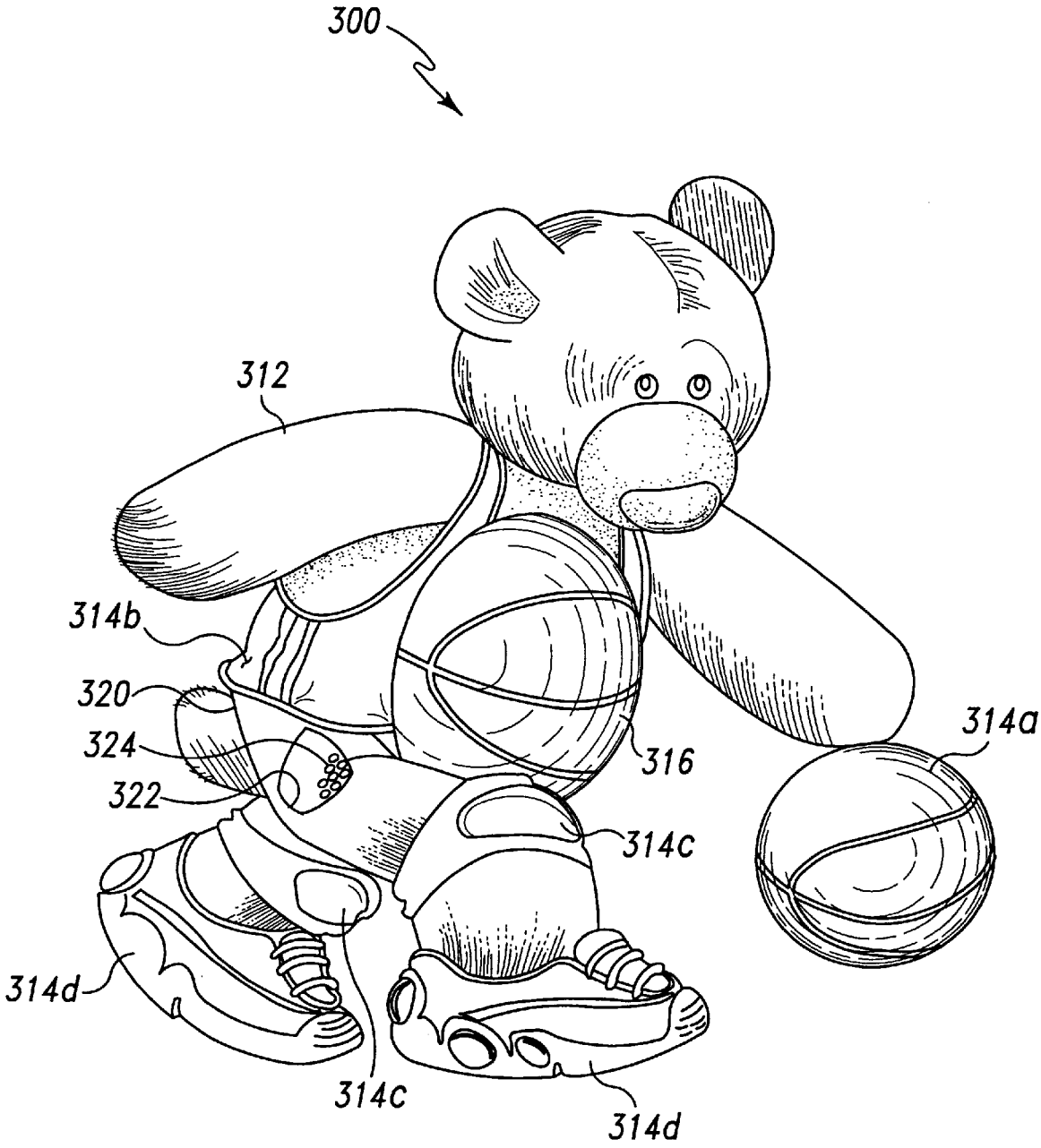
FIG. 7 is a perspective view of a third embodiment of an amusement device which incorporates the features of the present invention.

Referring now to FIG. 7, there is shown a third embodiment of an amusement device 300 which incorporates the features of the present invention therein. The amusement device 300 includes a body structure 312 which is configured to resemble a living being which is engaging in a specific activity. By way of example, FIG. 7 shows the living being to be a bear which is engaging in the sport of basketball. The body structure 312 includes an outer layer 320 which defines a stuffing cavity 322. Located within the stuffing cavity 322 is a quantity of stuffing material 324 which may be any known natural or synthetic material which is commonly utilized in the manufacture of stuffed toys. It should be appreciated that the presence of the stuffing material 324 gives the amusement device 300 a soft, compressible feel which is desirable to young children. Note that FIG. 7 shows a portion of the outer layer 320 removed to expose the interior of the stuffing cavity 322 for clarity of description.

The body structure 312 includes a torso, a pair of arms, a pair of legs, and a head as shown in FIG. 7. The body structure 312 supports a number of paraphernalia items 314 associated with a specific sporting activity in which the living being is engaging.

The paraphernalia items, collectively referred to in the text as reference number 314, include a basketball 314*a* supported by one of the hands defined by the body structure 312 via a few stitches sewn between such hand and the basketball 314*a*. The paraphernalia items 314 further include a basketball jersey 314b, a pair of knee pads 314c, and a pair of basketball shoes 314*d*. Each of the paraphernalia items 314 is configured so as to appear as if it is being worn by the bear as shown in FIG. 7.

The amusement device 300 further includes a belly member 316 supported by the body structure 312 at an abdominal area of the body structure 312. The belly member 316 is configured and positioned in relation to the body structure 312 so as to simulate an extended belly of the living being (i.e. the bear). The belly member 316 is configured to be at least a partial facsimile of the basketball 314*a*. More specifically, the belly member 316 is configured to be a reproduction or copy of at least a limited portion of the basketball 314*a*. The belly member 316 may be the same size as the corresponding limited portion of the basketball 314*a*, or alternatively may be reduced or enlarged in size in relation to such limited portion of the basketball. In the embodiment shown in FIG. 7, the belly member 316 is shown to be slightly enlarged in size in relation to such limited portion of the basketball 314*a*.

Fourth Embodiment

Figure 8:
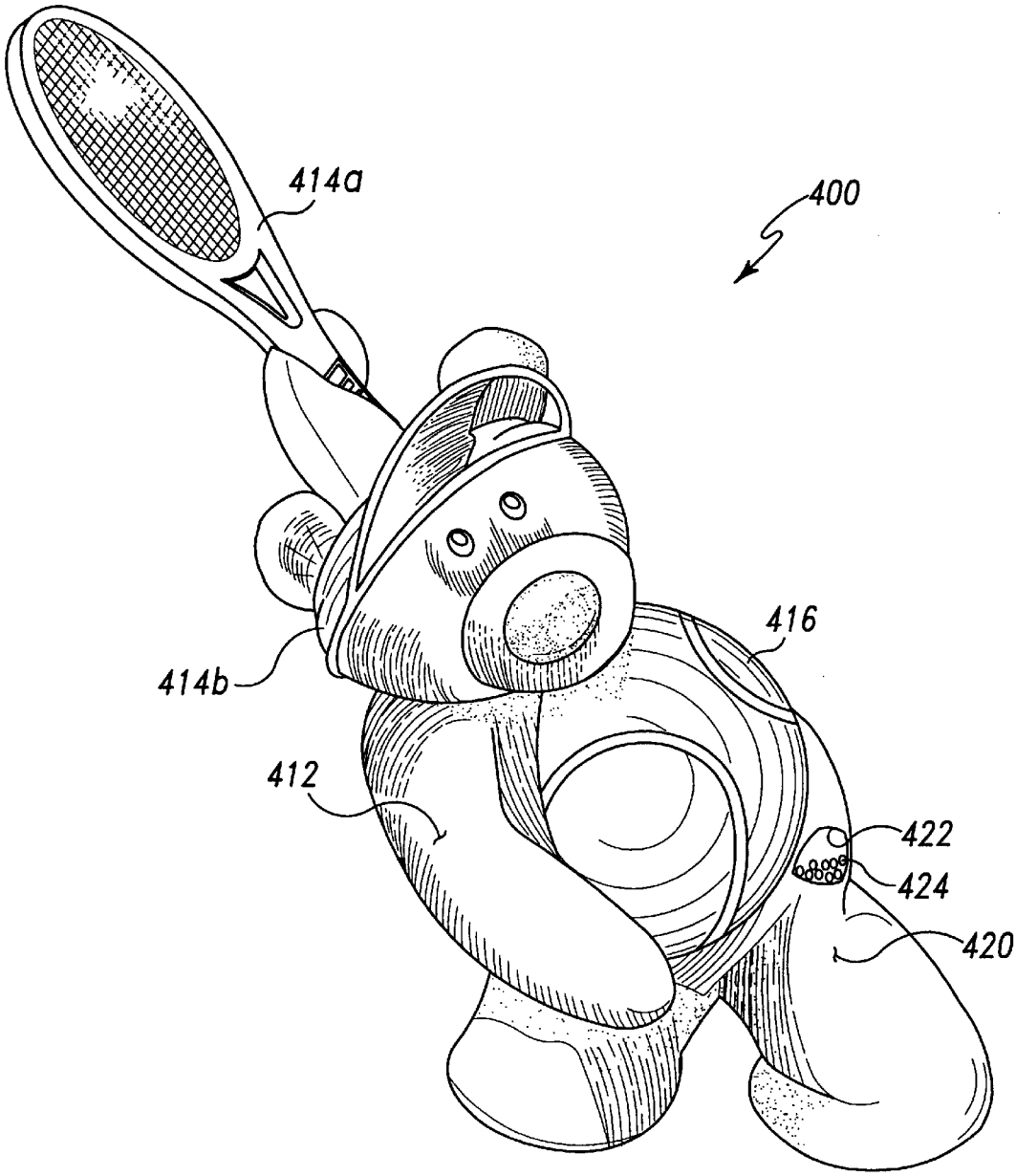
FIG. 8 is a perspective view of a fourth embodiment of an amusement device which incorporates the features of the present invention.

Referring now to FIG. 8, there is shown a fourth embodiment of an amusement device 400 which incorporates the features of the present invention therein. The amusement device 400 includes a body structure 412 which is configured to resemble a living being which is engaging in a specific activity. By way of example, FIG. 8 shows the living being to be a bear which is engaging in the sport of tennis. The body structure 412 includes an outer layer 420 which defines a stuffing cavity 422. Located within the stuffing cavity 422 is a quantity of stuffing material 424 which may be any known natural or synthetic material which is commonly utilized in the manufacture of stuffed toys. It should be appreciated that the presence of the stuffing material 424 gives the amusement device 400 a soft, compressible feel which is desirable to young children. Note that FIG. 8 shows a portion of the outer layer 420 removed to expose the interior of the stuffing cavity 422 for clarity of description.

The body structure 412 includes a torso, a pair of arms, a pair of legs, and a head as shown in FIG. 8. The body structure 412 supports a number of paraphernalia items 414 associated with a specific sporting activity in which the living being is engaging.

The paraphernalia items, collectively referred to in the text as reference number 414, include a tennis racket 414*a* supported by one of the hands defined by the body structure 412 via an adhesive material located between such hand and the tennis racket 414*a*. The paraphernalia items 414 further include a sun visor 414*b* which is secured to the head of the bear as shown in FIG. 8. The sun visor 414*b* is configured so as to appear as if it is being worn by the bear as shown in FIG. 8.

The amusement device 400 further includes a belly member 416 supported by the body structure 412 at an abdominal area of the body structure 412. The belly member 416 is configured and positioned in relation to the body structure 412 so as to simulate an extended belly of the living being (i.e. the bear). The belly member 416 is configured to resemble at least a portion of another paraphernalia item associated with the specific sporting activity in which the living being is engaging. In the embodiment shown in FIG. 8, this other paraphernalia item is a tennis ball. More specifically, the belly member 416 is configured to resemble at least a portion of a tennis ball. It should be appreciated that a tennis ball has a logical relationship with the sport of tennis because a tennis ball is used while a player engages in the sport of tennis.

Fifth Embodiment

Figure 9:
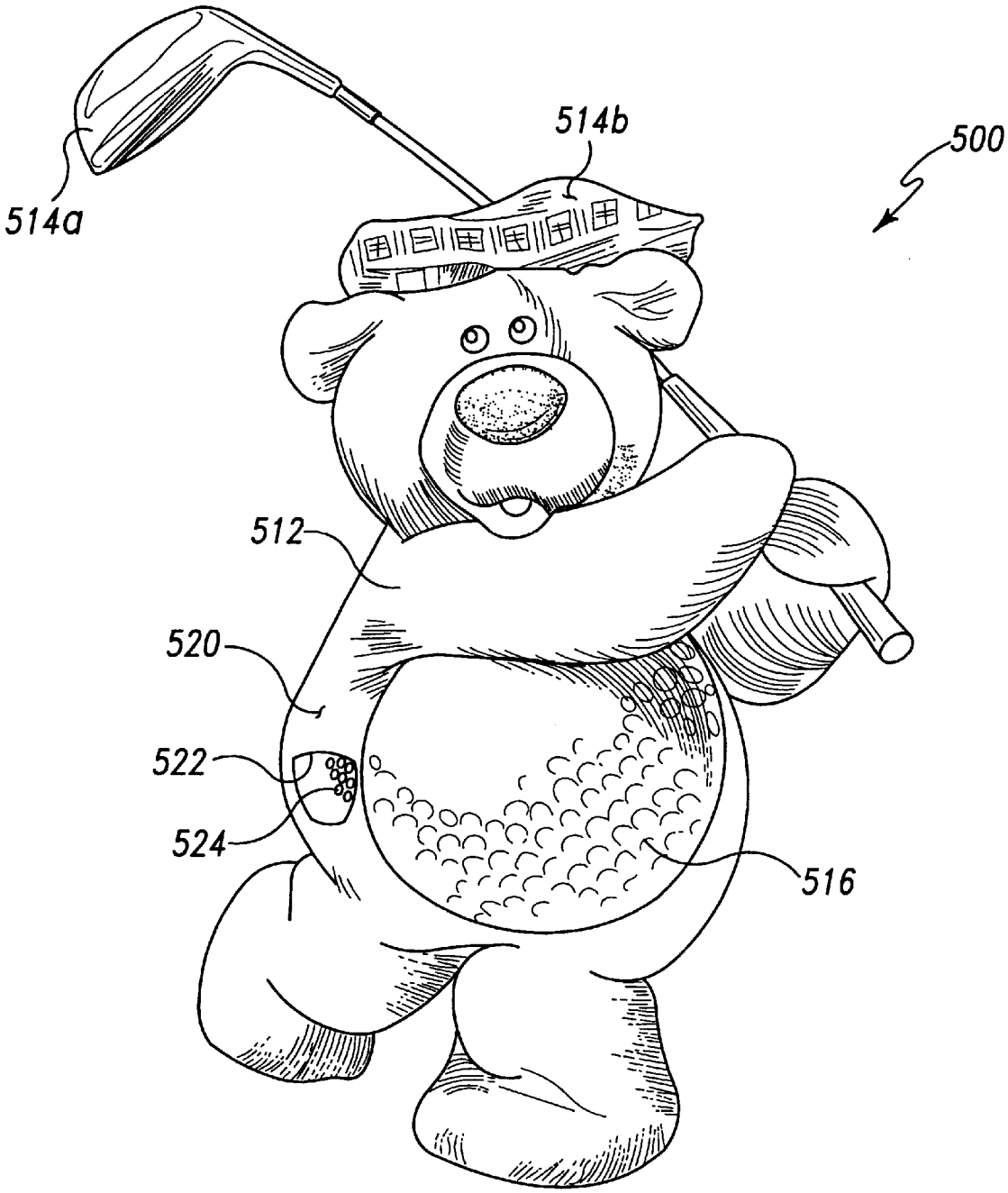
FIG. 9 is a perspective view of a fifth embodiment of an amusement device which incorporates the features of the present invention.

Referring now to FIG. 9, there is shown a fifth embodiment of an amusement device 500 which incorporates the features of the present invention therein. The amusement device 500 includes a body structure 512 which is configured to resemble a living being which is engaging in a specific activity. By way of example, FIG. 9 shows the living being to be a bear which is engaging in the sport of golfing. The body structure 512 includes an outer layer 520 which defines a stuffing cavity 522. Located within the stuffing cavity 522 is a quantity of stuffing material 524 which may be any known natural or synthetic material which is commonly utilized in the manufacture of stuffed toys. It should be appreciated that the presence of the stuffing material 524 gives the amusement device 500 a soft, compressible feel which is desirable to young children. Note that FIG. 9 shows a portion of the outer layer 520 removed to expose the interior of the stuffing cavity 522 for clarity of description.

The body structure 512 includes a torso, a pair of arms, a pair of legs, and a head as shown in FIG. 9. The body structure 512 supports a number of paraphernalia items 514 associated with a specific sporting activity in which the living being is engaging.

The paraphernalia items, collectively referred to in the text as reference number 514, include a golf club 514*a* supported by both of the hands defined by the body structure 512 via an adhesive material located between such hands and the golf club 514*a*. The paraphernalia items 514 further include a golf cap 514*b* which is secured to the head of the bear as shown in FIG. 9. The golf cap 514*b* is configured so as to appear as if it is being worn by the bear as shown in FIG. 9.

The amusement device 500 further includes a belly member 516 supported by the body structure 512 at an abdominal area of the body structure 512. The belly member 516 is configured and positioned in relation to the body structure 512 so as to simulate an extended belly of the living being (i.e. the bear). The belly member 516 is configured to resemble at least a portion of another paraphernalia item associated with the specific sporting activity in which the living being is engaging. In the embodiment shown in FIG. 9, this other paraphernalia item is a golf ball. More specifically, the belly member 516 is configured to resemble at least a portion of a golf ball. It should be appreciated that a golf ball has a logical relationship with the sport of golf because a golf ball is used while a player engages in the sport of golf.

Sixth Embodiment

Figure 10:
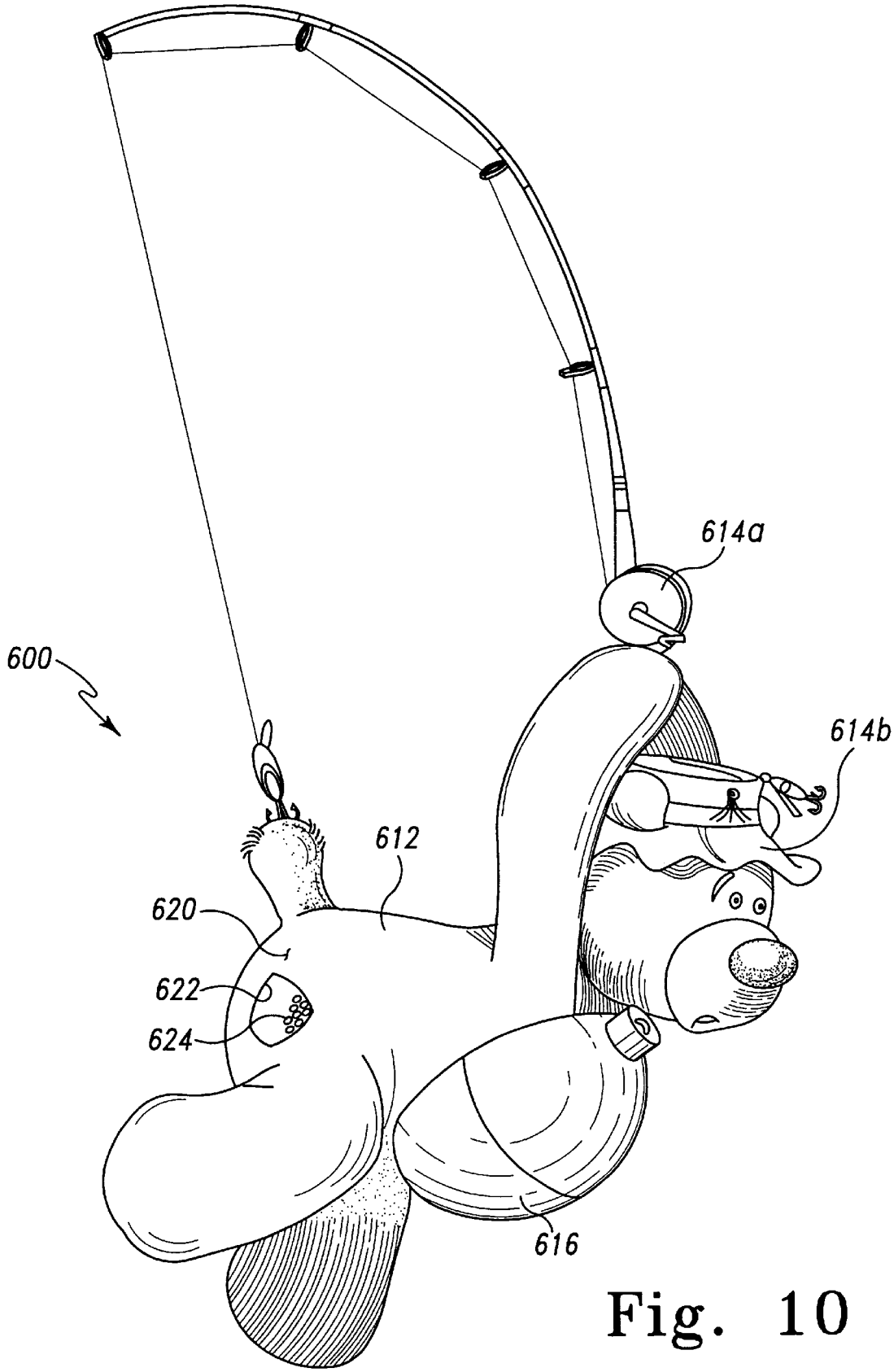
FIG. 10 is a perspective view of a sixth embodiment of an amusement device which incorporates the features of the present invention.

Referring now to FIG. 10, there is shown a sixth embodiment of an amusement device 600 which incorporates the features of the present invention therein. The amusement device 600 includes a body structure 612 which is configured to resemble a living being which is engaging in a specific activity. By way of example, FIG. 10 shows the living being to be a bear which is engaging in the sport of fishing. The body structure 612 includes an outer layer 620 which defines a stuffing cavity 622. Located within the stuffing cavity 622 is a quantity of stuffing material 624 which may be any known natural or synthetic material which is commonly utilized in the manufacture of stuffed toys. It should be appreciated that the presence of the stuffing material 624 gives the amusement device 600 a soft, compressible feel which is desirable to young children. Note that FIG. 10 shows a portion of the outer layer 620 removed to expose the interior of the stuffing cavity 622 for clarity of description.

The body structure 612 includes a torso, a pair of arms, a pair of legs, and a head as shown in FIG. 10. The body structure 612 supports a number of paraphernalia items 614 associated with a specific sporting activity in which the living being is engaging.

The paraphernalia items, collectively referred to in the text as reference number 614, include a fishing pole 614*a* supported by both of the hands defined by the body structure 612 via an adhesive material located between such hands and the fishing pole 614*a*. The paraphernalia items 614 further include a fishing hat 614*b* which is secured to the head of the bear as shown in FIG. 10. The fishing hat 614*b* is configured so as to appear as if it is being worn by the bear as shown in FIG. 10.

The amusement device 600 further includes a belly member 616 supported by the body structure 612 at an abdominal area of the body structure 612. The belly member 616 is configured and positioned in relation to the body structure 612 so as to simulate an extended belly of the living being (i.e. the bear). The belly member 616 is configured to resemble at least a portion of another paraphernalia item associated with the specific sporting activity in which the living being is engaging. In the embodiment shown in FIG. 10, this other paraphernalia item is a fishing bobber. More specifically, the belly member 616 is configured to resemble at least a portion of a fishing bobber. It should be appreciated that a fishing bobber has a logical relationship with the sport of fishing because it is common for a fisherman to use a fishing bobber while engaging in the sport of fishing.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

For example, while the "specific activity" in which the living being (e.g. the bear) is engaging is disclosed herein in each of the embodiments as being a sporting activity, it should be appreciated that the living being may be engaging in other activities which are recreational such as the activity of reading a book. Moreover, it should be appreciated that the living being may be engaging in other activities which are non-recreational such as a professional activity. One professional activity may be a dental activity such as drilling the tooth of a patient.

While the amusement device 10 was described herein as being made of a clay material, such device could be made from other materials such as porcelain, wood, metal (e.g. pewter or bronze), and plastic or polyresin such as polyethylene (e.g. a via an injection molding process).

While the above-described amusement devices 12, 200, 300, 400, 500, and 600 were described as having a belly member which is configured to resemble at least a portion of a paraphernalia item associated with a specific activity in which the living being is engaging, and has many advantages thereby, some of the advantages of the present invention may be achieved by replacing such belly member with another body member (e.g. a head member) which is configured to resemble at least a portion of a paraphernalia item associated with a specific activity in which the living being is engaging.

There are a plurality of advantages of the present invention arising from the various features of the amusement device described herein. It will be noted that alternative embodiments of the amusement device of the present invention may not include all of the features described yet still benefit from at least some of the advantages of such features. Those of ordinary skill in the art may readily devise their own implementations of the amusement device that incorporate one or more of the features of the present invention and fall within the spirit and scope of the present invention as defined by the appended claims.

What is claimed is:

1. An amusement device, comprising:

a body structure configured to resemble a living being which is engaging in a specific sporting activity, said body structure including a torso;

a paraphernalia item associated with said specific sporting activity supported by said body structure, said paraphernalia item being configured to be a complete model of an actual sporting item associated with said specific sporting activity; and a belly member supported by said body structure at an abdominal area of said body structure so as to simulate an extended belly of said living being, said belly member extending outwardly from said torso, wherein said belly member is configured to be at least a partial facsimile of said paraphernalia item.

2. The amusement device of claim 1, wherein:

the type of item represented by said paraphernalia item is a basketball.

3. The amusement device of claim 1, wherein:

the type of item represented by said paraphernalia item is a bowling ball.

4. The amusement device of claim 1, wherein:

said body structure and said belly member are each comprised of a clay material, and said body structure and said belly member are integrally formed together.

5. The amusement device of claim 1, wherein:

said body structure includes (i) an outer body layer which defines a stuffing cavity, and (ii) a stuffing material located in the stuffing cavity, and said belly member is secured to said outer body layer.

6. An amusement device, comprising:

a body structure configured to resemble a living being which is engaging in a specific recreational activity, said body structure including a torso;

a first paraphernalia item associated with said specific recreational activity supported by said body structure, said first paraphernalia item being configured to be a complete model of an actual recreational item associated with said specific recreational activity; and a belly member supported by said body structure at an abdominal area of said body structure so as to simulate an extended belly of said living being, said belly member extending outwardly from said torso, wherein said belly member is configured to resemble at least a portion of a second paraphernalia item associated with said specific recreational activity.

7. The amusement device of claim 6, wherein:

the type of item represented by said first paraphernalia item is a tennis racket, and the type of item represented by said second paraphernalia item is a tennis ball.

8. The amusement device of claim 6, wherein:

the type of item represented by said first paraphernalia item is a golf club, and the type of item represented by said second paraphernalia item is a golf ball.

9. The amusement device of claim 6, wherein said first paraphernalia item is different from said second paraphernalia item.

10. The amusement device of claim 6, wherein:

said body structure includes (i) an outer body layer which defines a stuffing cavity, and (ii) a stuffing material located in the stuffing cavity, and said belly member is secured to said outer body layer.

11. An amusement device, comprising:

a body structure configured to resemble a living being which is engaging in a specific activity, said body structure including a torso;

a paraphernalia item associated with said specific activity supported by said body structure, said paraphernalia item being configured to be a complete model of an actual item associated with said specific activity; and a belly member supported by said body structure at an abdominal area of said body structure so as to simulate an extended belly of said living being, said belly member extending outwardly from said torso, wherein said belly member is configured to be at least a partial facsimile of said paraphernalia item.

12. The amusement device of claim 11, wherein:

the type of item represented by said paraphernalia item is a basketball.

13. The amusement device of claim 11, wherein:

the type of item represented by said paraphernalia item is a bowling ball.

14. The amusement device of claim 11, wherein:

said body structure and said belly member are each comprised of a clay material, and said body structure and said belly member integrally formed together.

15. The amusement device of claim 11, wherein:

said body structure includes (i) an outer body layer which defines a stuffing cavity, and (ii) a stuffing material located in the stuffing cavity, and said belly member is secured to said outer body layer.

16. An amusement device, comprising:

a body structure configured to resemble a living being which is engaging in a specific activity, said body structure including a torso;

a first paraphernalia item associated with said specific activity supported by said body structure, said first paraphernalia item being configured to be a complete model of an actual item associated with said specific activity; and a belly member supported by said body structure at an abdominal area of said body structure so as to simulate an extended belly of said living being, said belly member extending outwardly from said torso, wherein said belly member is configured to resemble at least a portion of a second paraphernalia item associated with said specific activity.

17. The amusement device of claim 16, wherein:

the type of item represented by said first paraphernalia item is a tennis racket, and the type of item represented by said second paraphernalia item is a tennis ball.

18. The amusement device of claim 16, wherein:

the type of item represented by said first paraphernalia item is a golf club, and the type of item represented by said second paraphernalia item is a golf ball.

19. The amusement device of claim 16, wherein said first paraphernalia item is different from said second paraphernalia item.

20. The amusement device of claim 16, wherein:

said body structure includes (i) an outer body layer which defines a stuffing cavity, and (ii) a stuffing material located in the stuffing cavity, and said belly member is secured to said outer body layer.

* * * * *